US006877450B2

(12) United States Patent
Schmidt et al.

(10) Patent No.: US 6,877,450 B2
(45) Date of Patent: Apr. 12, 2005

(54) VARIABLE-DRAFT VESSEL

(75) Inventors: Terrence W. Schmidt, Santa Clara, CA (US); Anthony J. Mannino, Twain Harte, CA (US); Lewis D. Madden, Morgan Hill, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/712,798

(22) Filed: Nov. 12, 2003

(65) Prior Publication Data

US 2004/0134402 A1 Jul. 15, 2004

Related U.S. Application Data

(60) Provisional application No. 60/502,625, filed on Sep. 15, 2003, and provisional application No. 60/426,070, filed on Nov. 12, 2002.

(51) Int. Cl.[7] ..... B63B 1/00

(52) U.S. Cl. ..... 114/61.15; 114/61.13

(58) Field of Search ..... 114/61.1, 61.27, 114/66, 61.13, 61.14, 274, 61.15

(56) References Cited

U.S. PATENT DOCUMENTS

| | | | | | |
|---|---|---|---|---|---|
| 3,437,067 | A | * | 4/1969 | Malin | 114/61.1 |
| 3,481,297 | A | | 12/1969 | Mantle | |
| 4,287,845 | A | | 9/1981 | Sanner | |
| 4,440,103 | A | * | 4/1984 | Lang | 114/61.14 |
| 4,458,622 | A | | 7/1984 | Anderson | |
| 4,763,596 | A | * | 8/1988 | Yoshida | 114/61.1 |
| 4,878,447 | A | | 11/1989 | Thurston | |
| 5,117,774 | A | * | 6/1992 | English et al. | 114/66 |
| 5,224,436 | A | | 7/1993 | Stricker | |
| 5,313,906 | A | * | 5/1994 | Zapka | 114/274 |
| 5,390,623 | A | | 2/1995 | Mackaness | |
| 5,433,161 | A | * | 7/1995 | Loui | 114/61.14 |
| 5,465,678 | A | | 11/1995 | Ekman | |
| 5,517,940 | A | | 5/1996 | Beyer | |
| 5,592,895 | A | | 1/1997 | Schmidt | |
| 5,904,111 | A | | 5/1999 | Frigard | |
| 5,908,006 | A | | 6/1999 | Ibata | |
| 6,138,601 | A | | 10/2000 | Anderson et al. | |
| 2003/0154896 | A1 | | 8/2003 | Schmidt | |

OTHER PUBLICATIONS

"SWATH Overview", Ocean Engineering Consultants, Inc. (visited Oct. 27, 2003) <http://www.oecswath.com/what.asp> (2 pages).

Lockheed Martin's Advance Hullform Technologies, Bridging The Gap, http://ness.external.lmco.com/ms2 (2 pages).

* cited by examiner

*Primary Examiner*—Lars A. Olson
(74) *Attorney, Agent, or Firm*—McDermott Will & Emery LLP

(57) ABSTRACT

A variable-draft vessel. The variable-draft vessel including a center hull; a first side hull coupled to a first side of the center hull; a second side hull coupled to a second side of the center hull; and at least one cross support coupling the first and second side hulls, wherein the center hull is configured to be vertically translated with respect to the first and second side hulls.

28 Claims, 12 Drawing Sheets

VARIABLE-DRAFT VESSEL

CROSS-REFERENCES TO RELATED APPLICATIONS

This application claims the benefit of U.S. Provisional Patent Application No. 60/426,070, filed Nov. 12, 2002, titled Multi-Mission-Type Ship and Related Concepts, of Terrence W. Schmidt et al.; and claims the benefit of U.S. Provisional Patent Application No. 60/502,625, filed Sep. 15, 2003, titled Variable Depth/Variable Draft Catamaran (VDD CAT), of Terrance W. Schmidt et al., and are incorporated by reference herein in their entirety including all appendices thereto for all purposes.

BACKGROUND OF THE INVENTION

The present invention relates to vessels. More particularly, the present invention relates to a vessel having a variable draft, such that the vessel may be configured to operate in shallow waters and in deep waters.

Vessel hulls have traditionally been designed for specific uses, such as for use in shallow waters or in deep waters. Different hull designs provide for optimal operating characteristics for different uses. Shallow-draft vessels, for example, often have hulls that are relatively "flat" to maximize displacement and minimize draft, whereas deep-draft vessels often have v-shaped hulls that provide deep draft for desired seakeeping (e.g., good seakeeping providing low undesired motion, such as vertical motion or rocking).

More specifically, shallow-draft vessels are often designed with flat bottom hulls to provide the ability to navigate in relatively shallow waters, such as in shallow-water harbors, along rivers, along shorelines and in other bodies of shallow water. Shallow-draft vessels are also designed to maximize payload carrying capacity and to provide for simplified on-loading and off-loading of cargo. Examples of shallow-draft vessels include landing craft mechanized (LCM) and landing craft utility (LCU) that are often used by amphibious military forces to transport equipment and troops from sea to beachheads and/or to piers.

Shallow-draft vessels typically have relatively high water resistance due in part to large beam to length ratios, large wetted surfaces, and blunt water contact. Such characteristics provide for the generation of large amounts of resistance, such as turbulence and/or Kelvin wake, and high power requirements. Accordingly, shallow-draft vessels typically have poor seakeeping, poor ride, and poor handling characteristics. Due to these and other operational characteristics, shallow-draft vessels typically are not suited for use in deep water.

Alternatively, deep-draft vessels are often designed with v-hulls having relatively low beam to length ratios to provide the ability to navigate the vessels in deep waters, such as in the oceans and seas. Deep-draft vessels are often designed to provide desired seakeeping (e.g., good seakeeping providing low undesired motion, such as vertical motion or rocking) in high sea states. Deep-draft vessels, however, are typically not available for shallow-water use, such as docking in shallow harbors, river use, and navigation adjacent to shorelines, as the vessels may run-a-ground in these waterways.

A variety of operations require the use of vessels in both shallow and deep waters. As traditionally designed vessels typically have features that provide for optimized use in either shallow water or deep water, but not both, traditionally designed vessels do not provide optimal operating characteristics for both shallow and deep-water use.

Therefore, there is a need for vessels that may be operated in both shallow and deep waters, that provide for desired seakeeping and high speed operation in high sea states, and that provide high cargo carrying capacity with effective shallow-water operability.

BRIEF SUMMARY OF THE INVENTION

The present invention provides a vessel. More particularly, the present invention provides a vessel having a variable draft, such that the vessel may be configured to operate in shallow waters and in deep waters.

According to one embodiment of the present invention, a variable-draft vessel is provided that includes a center hull; a first side hull coupled to a first side of the center hull; a second side hull coupled to a second side of the center hull; and at least one cross support coupling the first and second side hulls, wherein the center hull is configured to be vertically translated with respect to the first and second side hulls. According to a specific embodiment, the vessel further includes lifting mechanism configured to vertically translate the center hull with respect to the first and second side hulls. The lifting mechanism may include a plurality of hydraulic actuators coupled between the center hull and the first and second side hulls.

According to another embodiment of the present invention, a variable-draft vessel is provided that includes a center hull that includes a first plurality of ballast tanks; a first side hull coupled to a first side of the center hull, the first side hull including a second plurality of ballast tanks; a second side hull coupled to a second side of the center hull, the second side hull including a third plurality of ballast tanks; and at least one cross support configured to couple the first and second side hulls, wherein the center hull is configured to be vertically translated with respect to the first and second side hulls by selectively transferring ballast water into or out of one or more of the ballast tanks.

According to another embodiment of the present invention, a variable-draft vessel is provided that includes a central hull; a plurality of struts coupled to the central hull, the struts extending downward with respect to the central hull; a plurality of pods coupled to the struts; and a plurality of floatation devices slidably coupled to the struts, wherein a draft of the pods is configured to be increased or decreased by vertically translating the floatation devices.

Numerous benefits may be achieved using the present invention over conventional vessels. For example, embodiments of the invention provide a vessel having a variable hull form and variable draft for operation in shallow and deep waters. Various hull forms provide for various operations modes and include two of three hulls having water contact (e.g., a deep-draft-transit mode), a center deck matched to a pier height (e.g., a deep-draft-pier-docking mode), three hulls having water contact (e.g., a shallow-draft mode), and a center hull relatively deep or submerged (e.g., a recovery mode). The above forms provide for variable seakeeping and fuel efficiency and may be selected for deep-water operation or shallow-water operation. The vessel may be transitioned from deep-water use to shallow-water use so that the vessel may be operated with a desired seakeeping (e.g., good seakeeping providing low undesired motion, such as vertical motion or rocking) in deep waters and high sea states and transitioned for use in shallow harbors, such as for pier docking, for landing on a beach, and for recovery of cargo and people afloat, for example, in the oceans or in seas. Depending upon the specific embodiment, there can be one or more of these benefits. These and other benefits can be found throughout the present specification and more particularly below.

A further understanding of the nature and advantages of the present invention may be realized by reference to the remaining portions of the specification and the drawings.

DETAILED DESCRIPTION OF THE INVENTION

The present invention provides a vessel. More particularly, the present invention provides a vessel having a variable draft, such that the vessel may be configured to operate in shallow waters and in deep waters.

Figure 1:
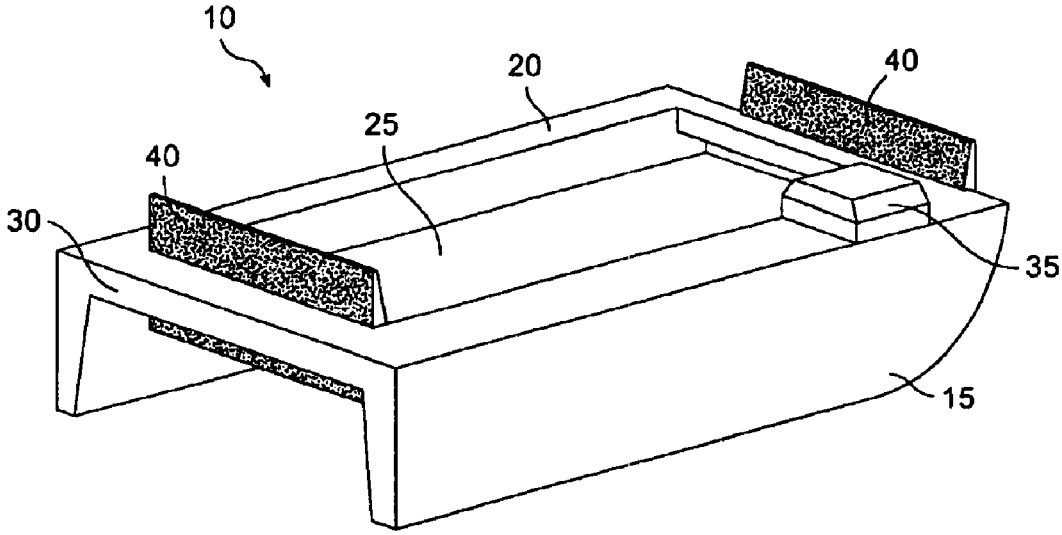
FIG. 1 is a simplified diagram of a vessel according to an embodiment of the present invention.

FIG. 1 is a simplified diagram of a vessel 10 according to an embodiment of the present invention. Vessel 10 includes a first side hull 15, a second side hull 20, a center hull 25, at least one cross support 30, and a control room 35. Various embodiments of vessel 10 also include one or more ramps 40. Cross support 30 is rigidly coupled to the side hulls to add structural integrity and stability to the vessel. While the cross support is shown as being attached to a top portion of the side hulls 15 and 20, the cross support may be attached to other portions of the side hulls.

Figure 2:
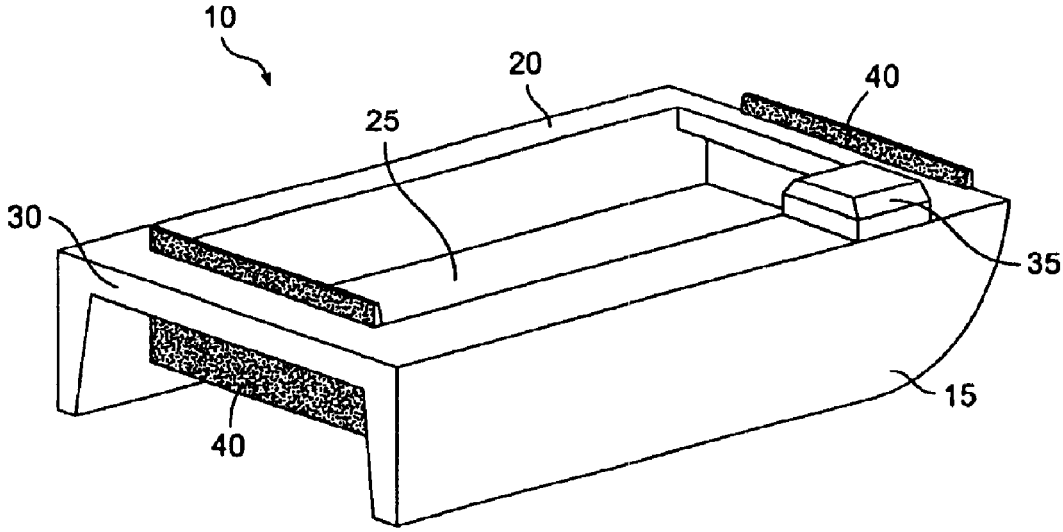
FIG. 2 is a simplified diagram of the center hull of a vessel at a height that matches a pier height.
Figure 3:
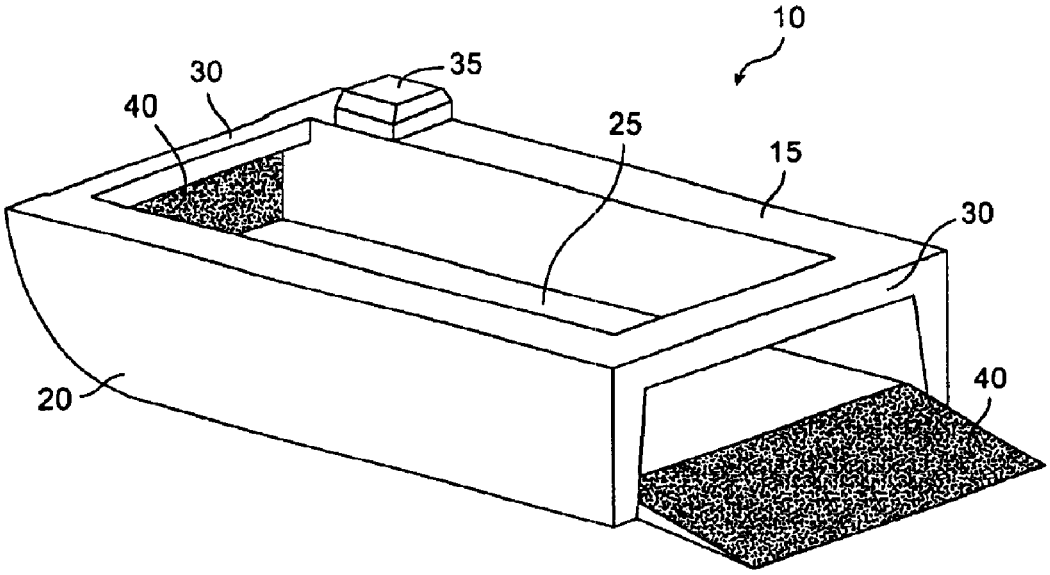
FIG. 3 is a simplified diagram of the center hull of a vessel lowered to a position such that each of the three hulls is in the water.
Figure 4:
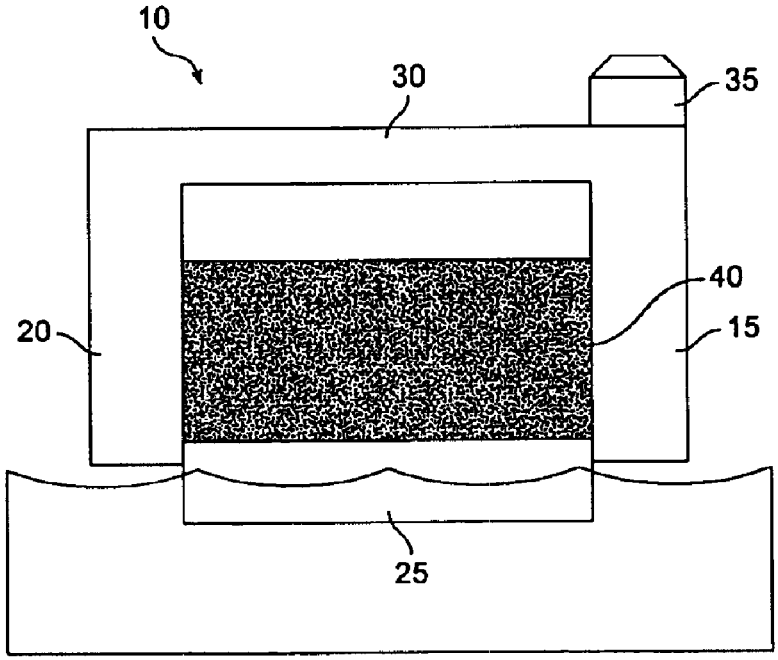
FIG. 4 is a simplified end view of a vessel and shows the center hull disposed relatively deep in the water such that side hulls are lifted out of the water.
Figure 5B:
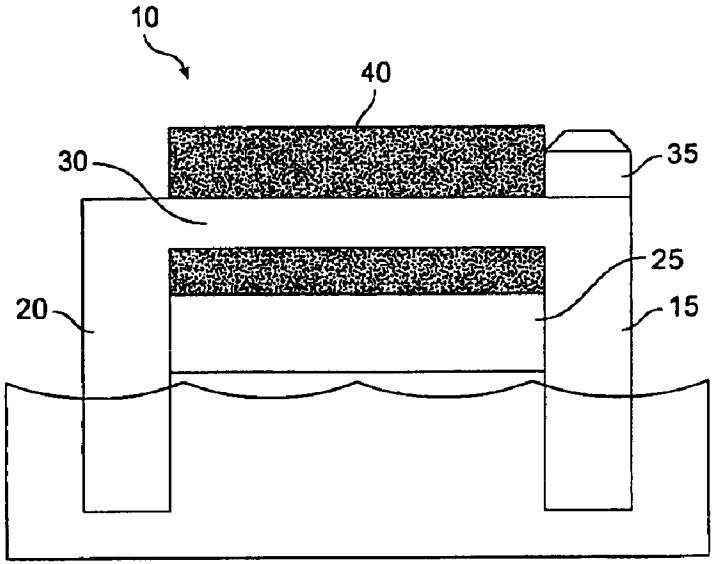
FIGS. 5A and 5B are simplified end views of a vessel showing the center hull in relatively low and high positions, respectively.
Figure 5A:
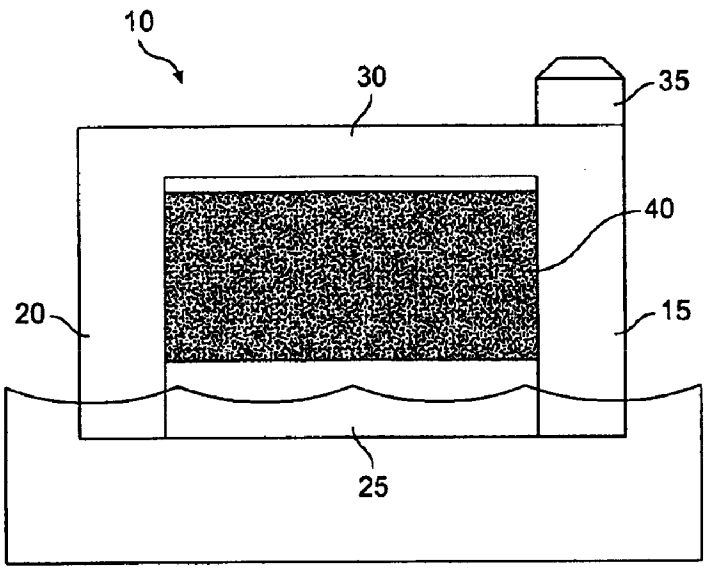

One or more of the three hulls may be in the water or lifted out of the water to change the configuration and operational characteristics of the vessel. To change the number of hulls in the water and the draft of the hulls, center hull 25 is configured to be vertically translated (i.e., elevated or lowered) relative to first and second side hulls 15 and 20. The center hull may be translated through a continuum of vertical positions or a set number of vertical positions. FIGS. 1, 2, 3, and 4 are simplified diagrams of vessel 10 that show the center hull in a number of vertical positions relative to the side hulls. FIG. 1 shows the center hull at a highest position above the water and the side hulls disposed relatively deep in the water. FIG. 2 shows the center hull at a height that matches a pier height, for example. FIG. 3 shows the center hull lowered to a position such that each of the three hulls is in the water. FIG. 4 is a simplified end view of vessel 10 and shows the center hull disposed relatively deep in the water such that side hulls are lifted out of the water. FIGS. 5A and 5B are end views of vessel 10 showing the center hull in relatively low and high positions, respectively. FIG. 5A is a simplified view of the side hulls in a configuration having a relatively shallow draft, whereas FIG. 5B is a simplified view of the side hulls in a configuration having a relatively deep draft. As the three hulls may be variously positioned vertically to adopt a variety of drafts, vessel 10 may be used for a variety of deep-water and shallow-water applications. A number of such applications will be described in detail below.

Figure 6A:
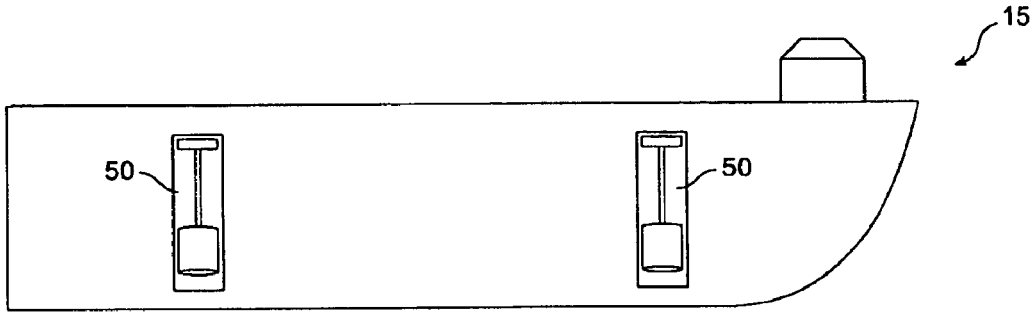
FIG. 6A is a simplified cross-sectional view of a side hull of the vessel having hydraulic actuators disposed therein.
Figure 6B:
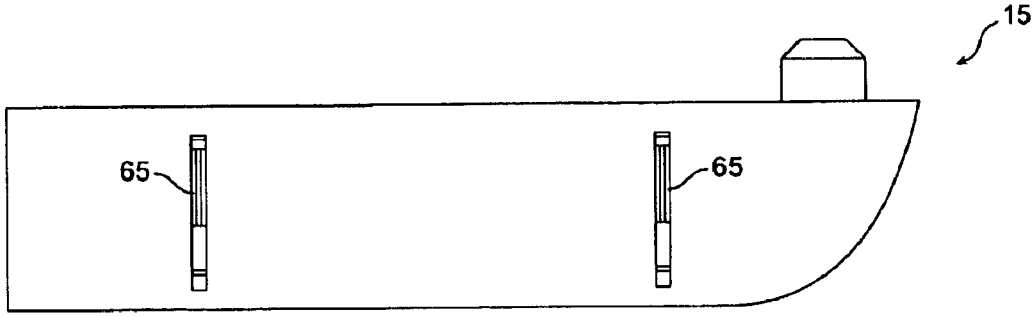
FIG. 6B is a simplified side view of a side hull of the vessel and shows a set of guides (e.g., slots) that are configured to guide the center hull during vertical translation.
Figure 7A:
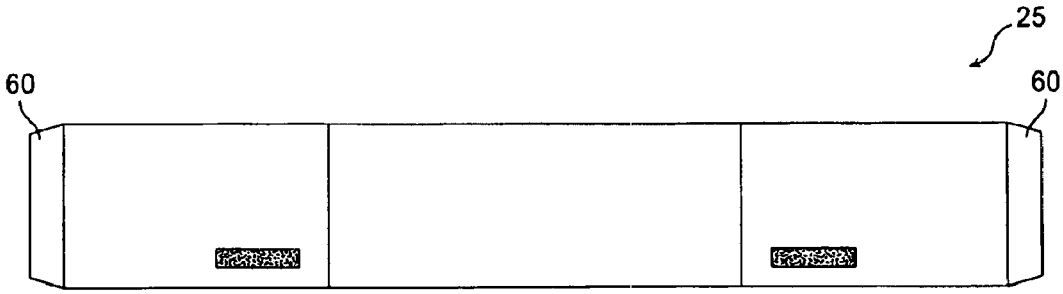
FIG. 7A is a simplified end view of a center hull showing a set of lift blocks configured to guide the center hull during vertical translation.
Figure 7B:
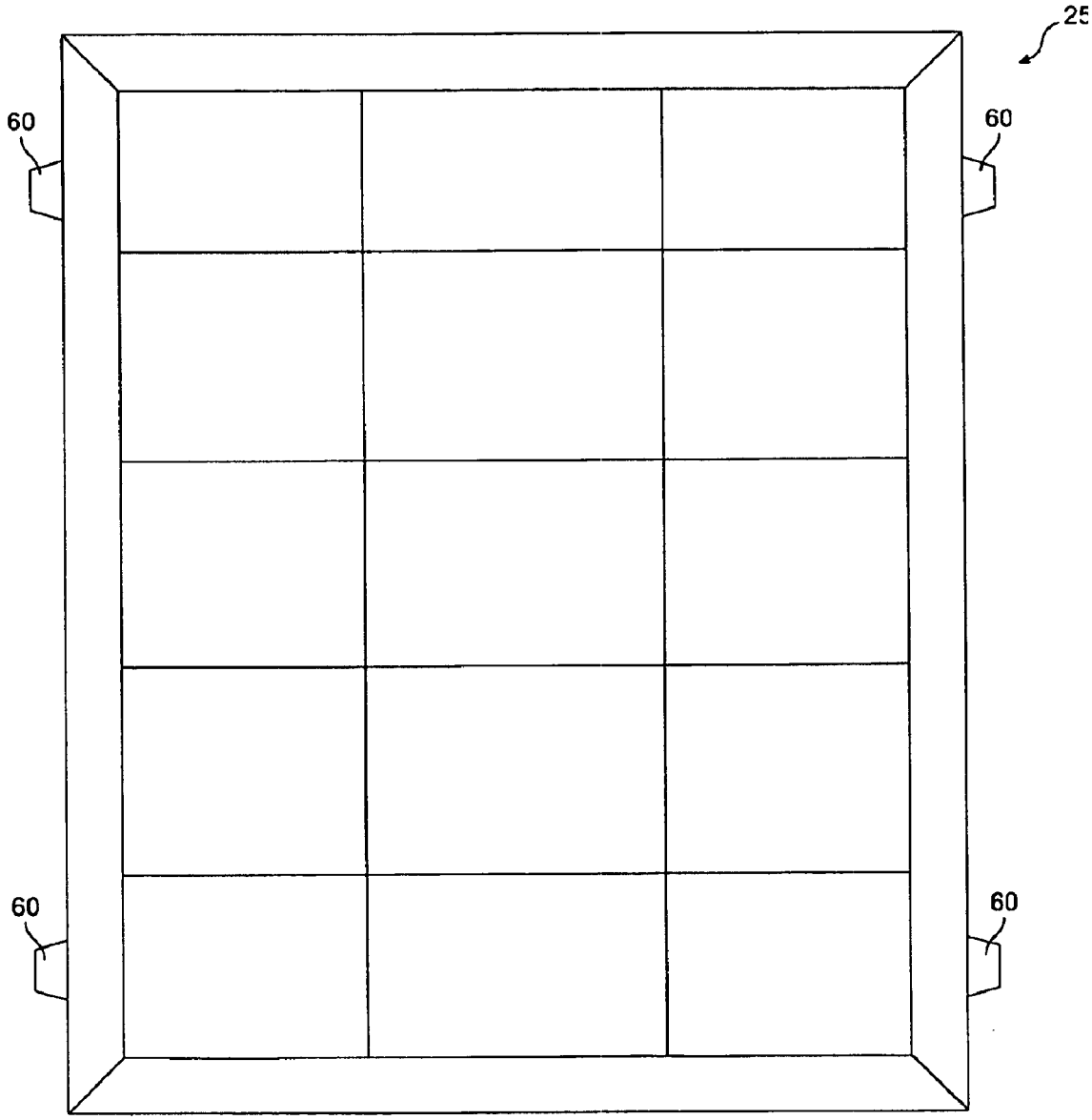
FIG. 7B is a simplified plan view of a center hull showing the set of lift blocks.

According to one embodiment, center hull 25 is vertically translated by a lifting mechanisms 50 as shown in FIG. 6A. Lifting mechanisms 50 may include: screw jacks, chain jacks, wire rope and linear winches, rack and pinions, hydraulic actuators or the like. According to the specific embodiment of the lifting mechanism shown in FIG. 6A, the lifting mechanisms include hydraulic actuators disposed in the side hulls. The hydraulic actuators may be configured to contact lift blocks on the center hull to vertically translate the center hull. FIGS. 7A and 7B are simplified end and plan views of center hull 25 showing a set of lift blocks 60 disposed on the center hull. The lift blocks may be configured to be translated along a set of guides to guide the center hull during vertical translation. FIG. 6B is a simplified side view of side hull 15 and shows a set of guides 65 (e.g., slots) that is configured to guide the center hull during vertical translation. While the guides are shown in FIG. 6B as slots that provide the lift blocks access to the hydraulic actuators, the guides may be disposed separate from the hydraulic actuators and may be configured to engage guide blocks disposed on the center hull. To provide for vertical translation of the center hull, the center hull may be unlocked from a locked position prior to translation and relocked subsequent to vertical translation.

Figure 8:
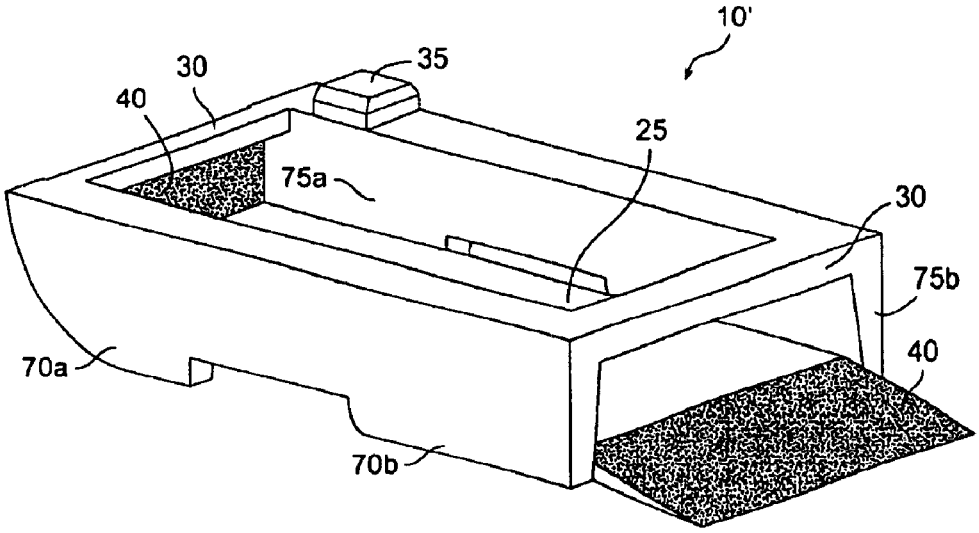
FIG. 8 is a simplified schematic of a vessel according to another embodiment of the present invention.

FIG. 8 is a simplified schematic of a vessel 10' according to another embodiment of the present invention. Similar number schema are used throughout the application to identify similar features. The embodiment of vessel 10' presently described differs from the embodiments described above in that vessel 10' includes a plurality of side hulls on each side of the vessel. According to the specific embodiment of vessel 10' shown in FIG. 8, the vessel includes first and second wings wall 70*a* and 70*b*, respectively, on one side of the vessel and includes third and forth side hulls 75*a* and 75*b*, respectively, on the other side of the vessel. Similar to embodiments described above, center hull 25 is configured to be vertically translated with respect to the side hulls.

Figure 9:
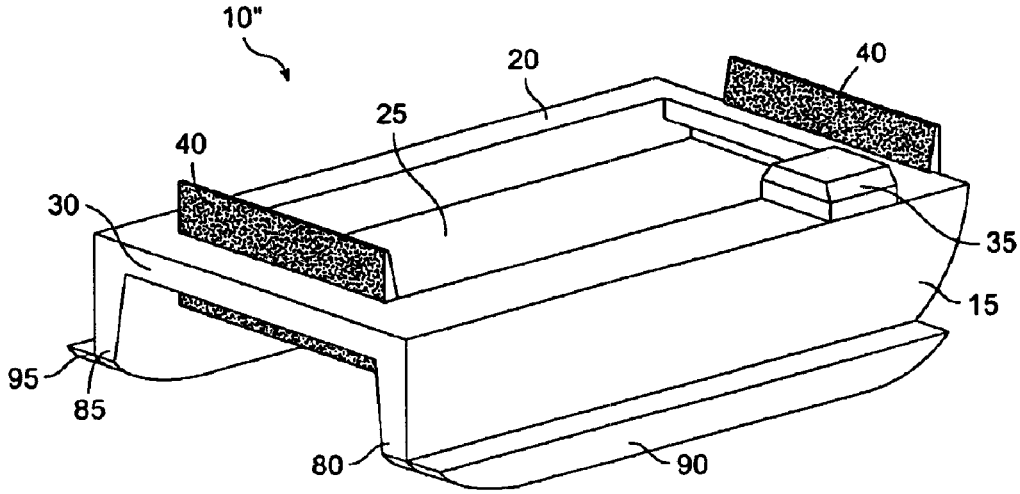
FIG. 9 is a simplified schematic of a vessel according to another embodiment of the present invention.

FIG. 9 is a simplified schematic of a vessel 10" according to another embodiment of the present invention. The embodiment of vessel 10" currently described differs from embodiments described above in that the side hulls of the vessel include struts coupled to hulls. As shown in FIG. 9, side hull 15 includes a strut 80 that is coupled to a hull 90, and side hull 20 includes a strut 85 that is coupled to a hull 95. While each of side hull 15 and 20 is shown to include a single strut coupled to a single hull, according to alternate embodiments, each side hull includes a plurality of struts coupled to a plurality of hulls.

Figure 10A:
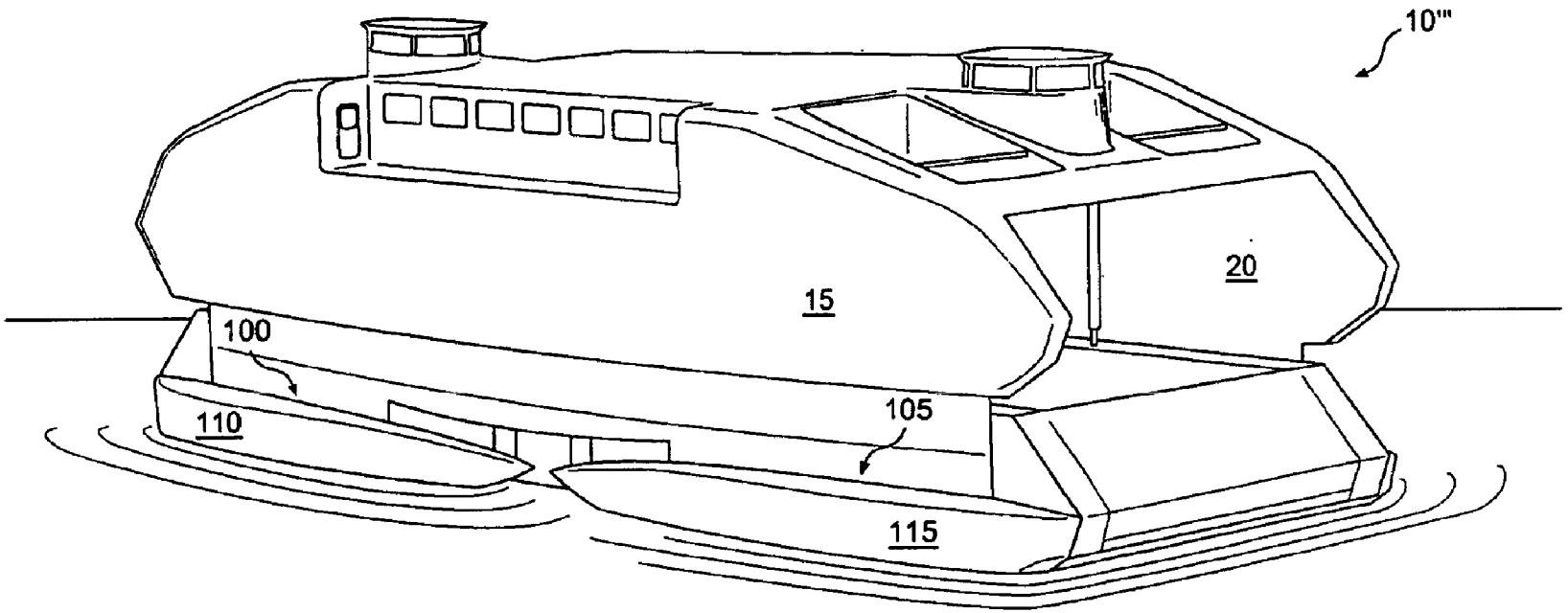
FIGS. 10A and 10B are simplified overall perspective views of a vessel having side hulls that include a plurality of struts coupled to a plurality of hulls according to another embodiment of the present invention.
Figure 10B:
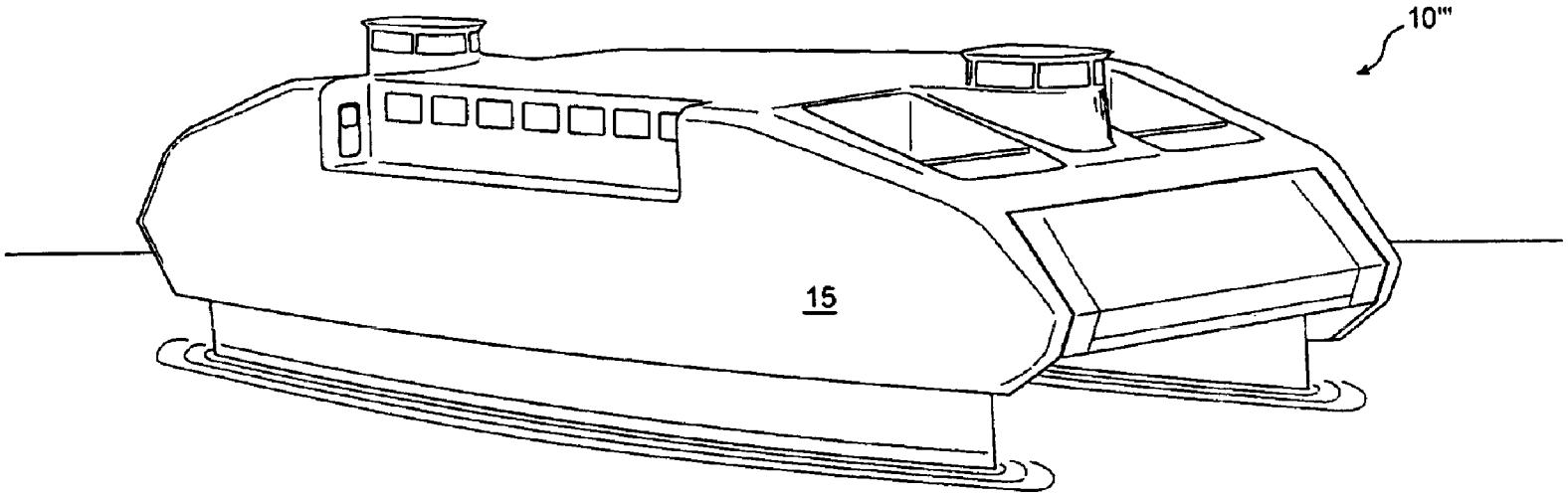
Figure 10C:
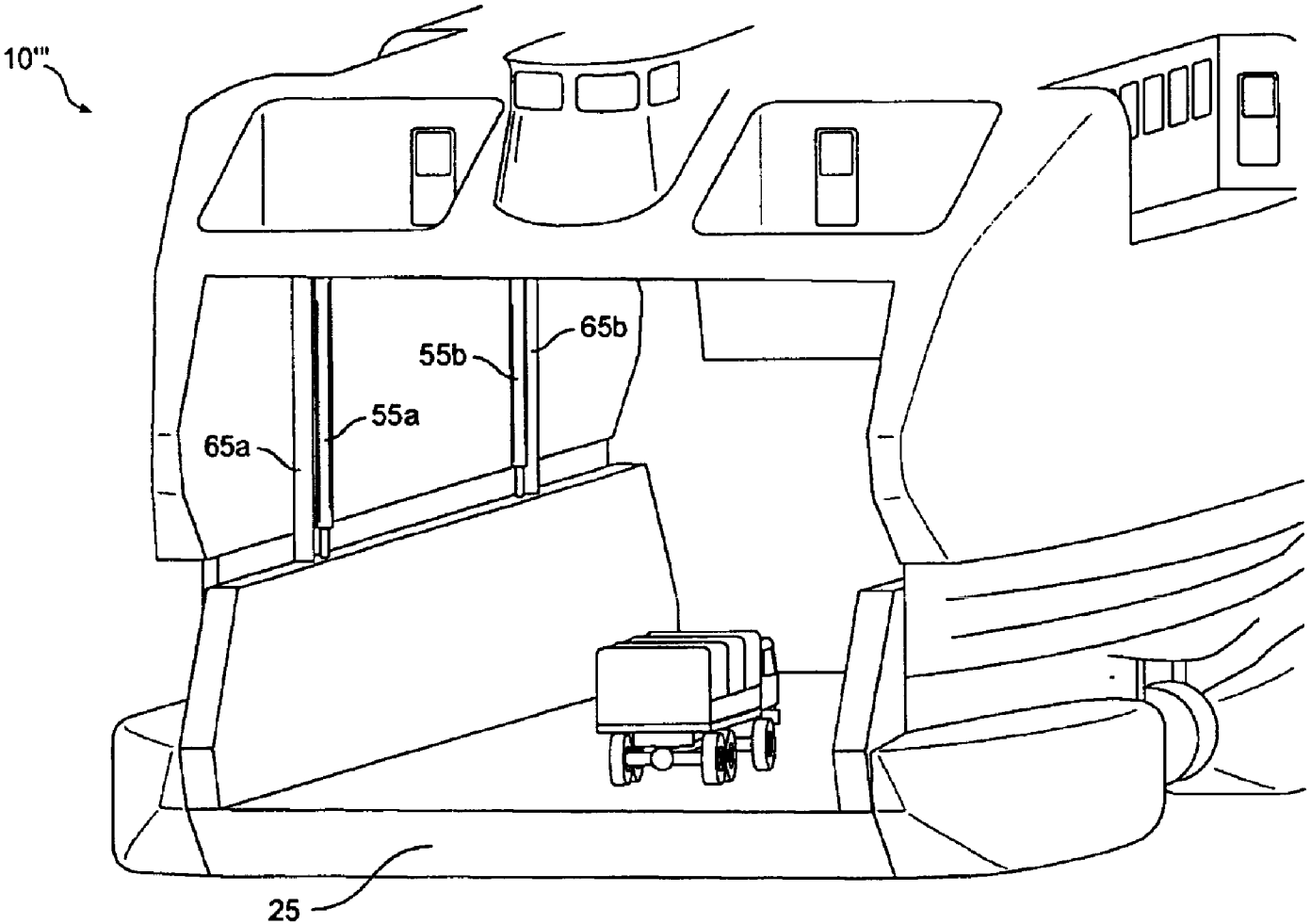
FIG. 10C is a simplified perspective view of a vessel showing a set of lifting mechanisms configured to vertically translate the center hull.

FIGS. 10A and 10B are simplified overall perspective views of a vessel 10'" having side hulls that include a plurality of struts coupled to a plurality of hulls according to another embodiment of the present invention. FIG. 10A shows a first side hull 15 that includes a first strut 100 and a second strut 105 respectively coupled to a first hull 110 and a second hull 115. Side hull 20 may be configured similarly to side hull 15. According to one embodiment, the hulls of the vessel 10'" may be configured as small water plane area twin hulls (SWATHs). FIG. 10A shows vessel 10'" having center hull 25 in a relatively low position (shallow hull draft) contacting the water, and FIG. 10B shows center hull 25 in a relatively high position (deep hull draft) and not contacting the water. The center hull may be vertically translated by lifting mechanisms similar to those described above. For example, FIG. 10C is a simplified perspective view of vessel 10'" and shows hydraulic actuators 55*a* and 55*b* configured to vertically translate center hull 25 according to an embodiment of the present invention. Guides 65*a* and 65*b* are configured to guide the center hull during vertical translation.

According to one embodiment, the side hulls and struts of a vessel are disposed relatively parallel to each other and may be disposed vertically with respect to the water surface or canted. Canting the struts may provide improved seakeeping and may provide a low radar profile as may be desired for various applications, such as military applications. Additionally, the side hulls, struts, and/or hulls may have slender-elongated shapes to reduce water resistance. Moreover, the side hulls may include a number of compartments, which may provide for fuel storage, include living quarters, house propulsion systems, and the like. Side hulls so configured may be wing walls. Wing walls may further include ballast tanks or the like. Wings walls may be barge structures.

According to one embodiment, the three hulls of a vessel are configured relatively symmetric from end to end so that the vessel may be operated forward and backward in a similar manner. Hull symmetry provides that vessel operations may be executed in both backward and forward traveling directions without the need to turn the vessel around. For example, symmetric hull configurations provide for low and high speed operations in both forward and backward directions.

As briefly described above, a vessel according to embodiments of the present invention may adapt a variety of characteristics associated with the variety of configuration the vessel may adopt. A number of characteristics and associated uses of the vessel are presently described. It should be understood that the characteristics and uses described are for exemplary purposes only. Those of skill in the art will recognize other characteristics and uses for vessels described herein. As shown in FIGS. 1, 2, and 9A, center hull 25 may be raised above the water, thereby forcing the side hulls relatively deep into the water (i.e., relatively deep draft). For convenience, such configurations are collectively referred to as the deep-draft-transit mode. The deep-draft-transit mode provides relatively high fuel efficiency as water resistance is relatively low. Also, as the overall hull form has relatively low water plane area, the deep-draft-transit mode provides relatively good seakeeping (i.e., low undesired motion, such as vertical motion or tilting/rocking). The deep-draft-transit mode is of particular use in high seas, as the center hull may be raised relatively high to reduce wave slamming into the underside of the center hull.

In deep-draft-transit mode, the height of the center hull may be adjusted such that a top deck of the center hull approximately matches, for example, the height of a pier or the like. For convenience, a vessel's configuration in which the height of the center hull's top deck is matched to a pier height is referred to as the deep-draft-pier-docking mode. Deep-draft-pier-docking mode provides for simplified loading and offloading of cargo and passengers. For example, in the deep-draft-pier-docking mode, a ramp at one end of the vessel may be unfolded as shown in FIG. 3 and matched to a pier height so that vehicles may be driven onto and off the vessel. According to a further embodiment, another ramp disposed at the other end of the vessel may be used for off loading vehicles, so that the vehicles may be driven in a forward direction from the vessel.

In deep-draft-transit mode, the center hull may be lifted to a height to provide for simplified cleaning and/or repair of the underside of the center hull without the need to dry dock the vessel. Similarly, with the side hulls lifted above the water (referred to as the recovery mode, see FIG. 4) the side hulls may be cleaned and/or repaired without the need to dry dock the vessel. Various exemplary uses for the vessels in recovery mode will be discussed in further detail below.

As shown in FIG. 3, each of the side hulls and the center hull are in the water. For convenience, the configuration of the vessel shown in FIG. 3 is referred to as the shallow-draft mode. As each of the three hulls is in the water, the hull form is similar to flat-bottomed-monohull vessels and has a relatively high buoyancy and relatively low draft. The additional buoyancy provides that the vessel may be used for relatively heavy cargoes and may be used in a barge like manner. For example, the vessel may be used to transport a number of cars, trucks and other vehicles. Moreover, in the shallow-draft mode, the vessel may be operated in shallow waters, such as in shallow-water harbors, rivers, along shorelines, and landed at beaches (e.g., to load and offload cargo at a beachhead).

As briefly discussed above, the vessel may be operated in a recovery mode in which the center hull may be partially or totally submerged (see FIG. 5). The recovery mode may be used to recover floating items, such as cargo that has fallen in the water or may be used for rescue work to remove people from the water. For example, passengers from aviation accidents, boating accidents, or soldiers executing military operations may be recovered relatively simply by lowering one or more of the ramps to scoop the passengers from the water. The recovery mode also provides for simplified launching of watercraft that may be stowed on a top deck of the center hull. As briefly described above, the center hull may be vertically translated to such depths that the side hulls are lifted from the water, therefore, providing for maintenance (e.g., cleaning) without the need for dry-docking.

Figure 11A:
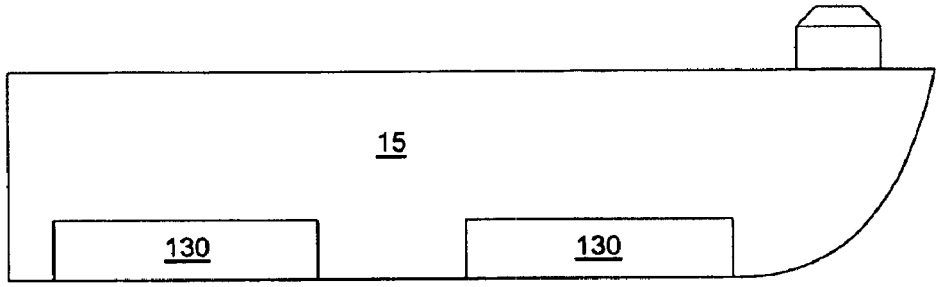
FIG. 11A is simplified cross-sectional view of a side hull showing a number of ballast tanks in which ballast water may be added or removed to vertically translate the side hull relative to the center hull or tilt the vessel.
Figure 11B:
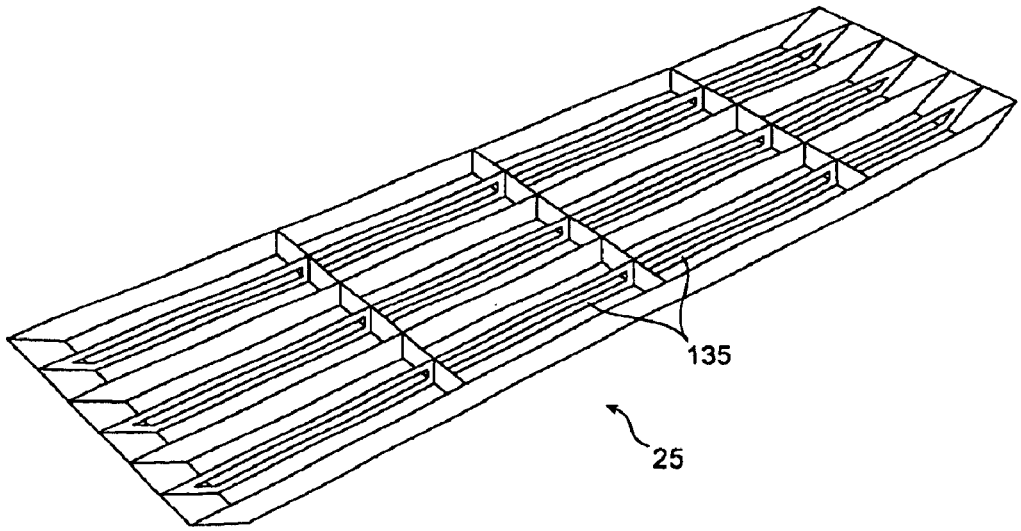
FIG. 11B is a simplified relief view of a center hull showing a number of ballast tanks in which ballast water may be added or removed to vertically translate the side hulls relative to the center hull or to tilt the vessel.

According to one embodiment, ballast water is transferred to and from the three hulls to transition a vessel from one configuration to another configuration. FIG. 11A is a cross-sectional view of side hull 15 showing a number of ballast tanks 130 in which ballast water may be added or removed to vertically translate the side hulls relative to the center hull. While FIG. 11A shows side hull 15 as including two ballast tanks, the side hull may include any number of ballast tanks. Side hull 20 may be similarly configured to include any number of ballast tanks. FIG. 11B is a relief view of center hull 25 showing a number of ballast tanks 135 in which ballast water may be added or removed to vertically translate the side hulls relative to the center hull. During ballast water transfer to and from the three hulls, the center hull may be unlocked from the side hulls allowing the center hull to float up or down in the guides. For example, to transition a vessel from deep-draft-transit mode to shallow-draft mode or recovery mode, the center hull may be unlocked and ballast water added to ballast tanks 135 in the center hull and/or removed from ballast tanks 130 in the side hulls to depress the center hull into the water and allow the side hulls to float up. After the vessel is configured in shallow-draft mode or recovery mode, the center hull may then be locked into position. Alternatively, to transition the vessel from the shallow-draft mode or the recovery mode to the deep-draft-transit mode, the center hull may be unlocked and allowed to float up or down as ballast water is removed or added to ballast tanks 130 and/or removed from ballast tanks 135. After the vessel is in the deep-draft-transit mode, the center hull may be locked into position. Various methods may be used to add and remove ballast water from the three hulls, for example, ballast water may be added or removed using air pressure, pumps, free flooding or other means. According to one embodiment, a vessel having ballast tanks configured to vertically translate the center hull relative to the side hulls may or may not include additional lifting mechanism, such as screw jacks, chain jacks, wire rope and linear winches, rack and pinions, or hydraulic actuators (described above in detail).

Figure 12A:
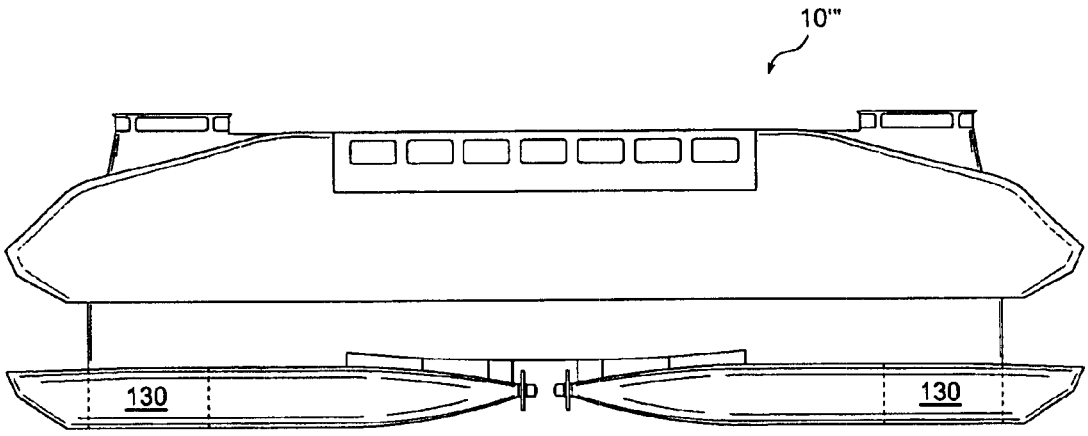
FIG. 12A is a simplified relief view of a vessel that includes a plurality of ballast tanks in side hulls of the vessel.
Figure 12B:
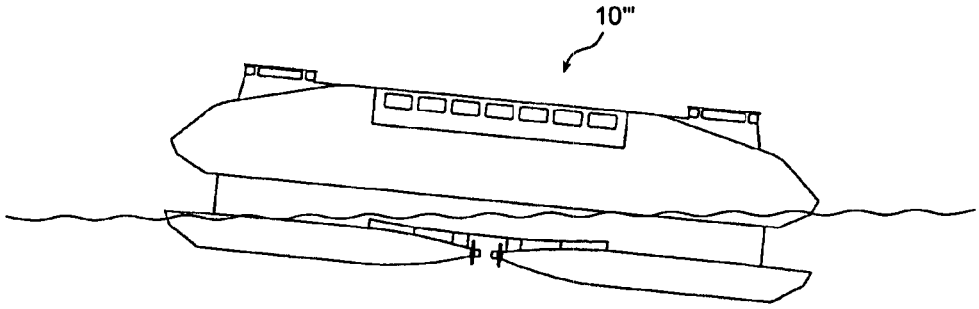
FIG. 12B is a simplified side view of a vessel in a titled position having ballast water disposed in ballast tanks at one end of the vessel to tilt the vessel.

According to one embodiment, a vessel may be variously ballasted at one end or one side, for example, to tilt or level a vessel. One end of a vessel may be heavily ballasted to tilt the vessel into the water, for example, to provide simplified loading and offloading of cargo in shallow-draft mode or recovery mode. Alternatively, one side of a vessel may be ballasted to level a vessel. A vessel may be leveled, for example, if a ballast tank one side of a vessel is flooded and cannot be drained. FIG. 12A is a relief view of vessel 10''' showing a number of ballast tanks 130 in the side hulls and more particularly in the hulls, which may be variously filled to tilt or level the vessel. FIG. 12B shows vessel 10''' tilted with respect to the water as one or more ballast tanks at one end of the vessel may be filled to effect the tilt.

According to another embodiment, a vessel may be transitioned between various configurations to provide various operational characteristics for a single mission. For example, cargo may be loaded from a pier in deep-draft-pier-docking mode, transported with the center hull raised to a relatively high position in deep-draft-transit mode, and then the center hull may be lowered to shallow-draft mode for delivery of the cargo at a beach or the like. It should be understood that the foregoing vessel uses are described for exemplary purposes only and are not intended to be limiting on the invention. Those of skill in the art will readily recognize other uses for vessels described herein.

Figure 13A:
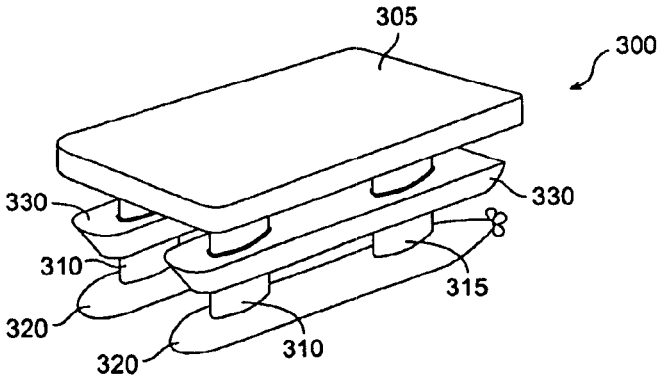
FIGS. 13A–13E are simplified diagrams of a vessel having a variable draft according to another embodiment of the present invention.
Figure 13B:
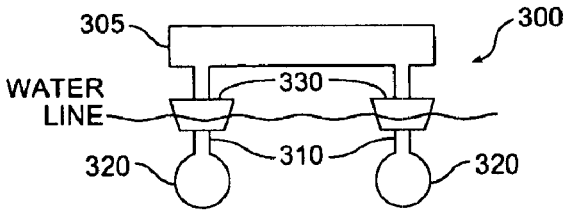
Figure 13C:
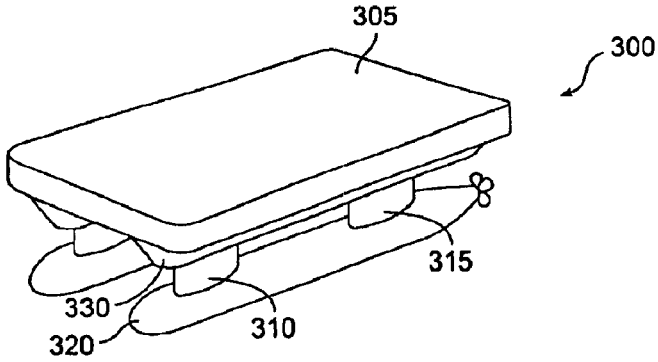
Figure 13D:
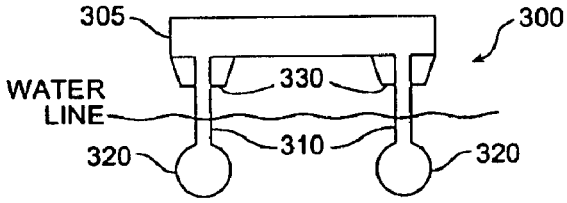
Figure 13E:
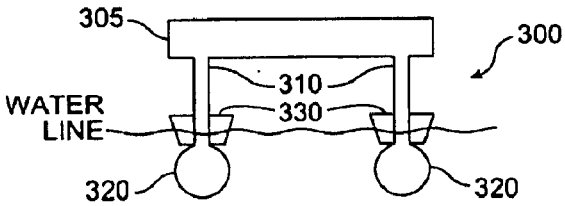

FIGS. 13A–13E are simplified diagrams of a vessel 300 according to another embodiment of the present invention. Vessel 300 includes a central hull 305, forward struts 310, aft struts 315, pods 320, and floatation devices 330. Vessel 300 may be variously configured to change the draft of the pods and thereby change the operating characteristics of the vessel by vertically translating (e.g., elevating or lowering) floatation devices 330. In a deep-draft-transit mode, the floatation devices may be raised relatively high with respect to the struts to increase the draft of the pods. FIGS. 13C and 13D show vessel 300 in a deep-draft-transit mode with floatation devices 330 in a raised position and with pods 320 disposed relatively deep in the water. In a shallow-draft mode, the floatation devices may be positioned relatively low with respect to the struts to decrease the draft of the pods. FIG. 13E shows vessel 300 in a shallow-draft mode having the floatation devices in lowered position. In a pier-docking mode, the floatation devices may be set at a position to approximately match a top deck of the central hull to a pier height or other desired height and to minimize contact of the floatation devices with a pier or the like. FIGS. 13A and 13B show the vessel in a pier-docking mode. While the forward and aft struts are shown as being relatively vertically disposed with respect to the surface of the water, the struts canted. Moreover, while, vessel 300 is shown in FIGS. 13A–13E as including one forward strut and one aft strut on either side of the vessel, the vessel may include fewer for more struts. Moreover, while vessel 300 is shown to include one pod on each side of the vessel, the vessel may include two or more pods per side and may include one or more floatation devices on each side of the vessel. A vessel having a plurality of floatation devices on each side of the vessel may be configured to selectively raise or lower the floatation devices to tilt or level the vessel.

It is to be understood that the examples and embodiments described above are for illustrative purposes only and that various modifications or changes in light thereof will be suggested to persons skilled in the art and are to be included within the spirit and purview of this application and scope of the appended claims. Therefore, the above description should not be taken as limiting the scope of the invention as defined by the claims.

What is claimed is:

1. A vessel comprising:

a center hull;

a first side hull coupled to a first side of the center hull;

a second side hull coupled to a second side of the center hull;

at least one cross support coupling the first and second side hulls; and a ramp coupled to a first end of the center hull, wherein the center hull is configured to be vertically translated with respect to the first and second side hulls.

2. The vessel of claim 1, further comprising another ramp coupled to a second end of the center hull.

3. A vessel comprising:

a center hull;

a first side hull coupled to a first side of the center hull;

a second side hull coupled to a second side of the center hull;

at least one cross support coupling the first and second side hulls, and a lifting mechanism configured to vertically translate the center hull with respect to the first and second side hulls, wherein the center hull is configured to be vertically translated with respect to the first and second side hulls, wherein the lifting mechanism includes a plurality of hydraulic actuators coupled between the center hull and the first and second side hulls, and wherein the hydraulic actuators are disposed in the side hulls.

4. A vessel comprising:

a center hull;

a first side hull coupled to a first side of the center hull;

a second side hull coupled to a second side of the center hull;

at least one cross support coupling the first and second side hulls; and a lifting mechanism configured to vertically translate the center hull with respect to the first and second side hulls, wherein the center hull is configured to be vertically translated with respect to the first and second side hulls, and wherein the lifting mechanism includes a plurality of ballast tanks disposed in the center hull and in the side hulls.

5. The vessel of claim 4, wherein the center hull is configured to be vertically translated with respect to the first and second side hulls by selectively transferring ballast water into or out of one or more of the ballast tanks.

6. The vessel of claim 4, wherein the center hull is configured to be tilted by selectively transferring ballast water into or out of one or more of the ballast tanks.

7. A vessel comprising:

a center hull;

a first side hull coupled to a first side of the center hull;

a second side hull coupled to a second side of the center hull; and at least one cross support coupling the first and second side hulls;

wherein the center hull is configured to be vertically translated with respect to the first and second side hulls, and wherein the side hulls are walls.

8. A vessel comprising:

a center hull;

a first side hull coupled to a first side of the center hull;

a second side hull coupled to a second side of the center hull; and at least one cross support coupling the first and second side hulls;

wherein the center hull is configured to be vertically translated with respect to the first and second side hulls, and wherein the side hulls include a plurality of guides, and the center hull includes a plurality of lifting blocks configured to engage the guides to vertically guide the center hull during vertical translation thereof.

9. The vessel of claim 8, wherein the lifting blocks are coupled to the lifting mechanism to vertically translate the center hull.

10. A vessel comprising:

a center hull;

a first side hull coupled to a first side of the center hull;

a second side hull coupled to a second side of the center hull; and at least one cross support coupling the first and second side hulls;

wherein the center hull is configured to be vertically translated with respect to the first and second side hulls, and wherein the side hulls are configured to be lifted above a surface of a body of water.

11. A vessel comprising:

a center hull;

a first side hull coupled to a first side of the center hull;

a second side hull coupled to a second side of the center hull; and at least one cross support coupling the first and second side hulls;

wherein the center hull is configured to be vertically translated with respect to the first and second side hulls, wherein the first side hulls includes one or more struts coupled to one or more hulls, wherein the second side hulls includes one or more struts coupled to one or more hulls, and wherein the struts are vertically disposed.

12. A vessel comprising:

a center hull;

a first side hull coupled to a first side of the center hull;

a second side hull coupled to a second side of the center hull; and at least one cross support coupling the first and second side hulls;

wherein the center hull is configured to be vertically translated with respect to the first and second side hulls, wherein the first side hulls includes one or more struts coupled to one or more hulls, wherein the second side hulls includes one or more struts coupled to one or more hulls, and wherein the struts are canted.

13. A vessel comprising:

a center hull that includes a first plurality of ballast tanks;

a first side hull coupled to a first side of the center hull, the first side hull including a second plurality of ballast tanks;

a second side hull coupled to a second side of the center hull, the second side hull including a third plurality of ballast tanks; and at least one cross support configured to couple the first and second side hulls, wherein the center hull is configured to be vertically translated with respect to the first and second side hulls by selectively transferring ballast water into or out of one or more of the ballast tanks.

14. The vessel of claim 13, further comprising a first ramp coupled to a first end of the center hull.

15. The vessel of claim 14, further comprising a second ramp coupled to a second end of the center hull.

16. The vessel of claim 13, wherein the center hull is configured to be vertically translated with respect to the first and second side hulls to change the draft of the vessel.

17. The vessel of claim 13, wherein the side hulls are wing walls.

18. The vessel of claim 13, wherein a draft of the first and second side hulls increases when the center hull is translated upward.

19. The vessel of claim 13, wherein a draft of the first and second side hulls decreases when the center hull translated downward.

20. The vessel of claim 13, wherein the center hull is configured to be vertically translated with respect to the first and second side hulls to change the draft of the vessel.

21. A vessel comprising:

a central hull;

a plurality of struts coupled to the central hull, the struts extending downward with respect to the central hull;

a plurality of pods coupled to the struts; and a plurality of floatation devices slidably coupled to the struts, wherein a draft of the pods is configured to be increased or decreased by vertically translating the floatation devices.

22. The vessel of claim 21, wherein the plurality of pods includes at least a first pod and a second pod.

23. The vessel of claim 22, wherein the plurality of floatation devices includes at least a first floatation device and a second floatation device.

24. The vessel of claim 23, wherein the plurality of struts includes at least a first forward strut, a second forward strut, a first aft strut, and a second aft strut.

25. The vessel of claim 2, wherein the first forward strut and the first aft strut are coupled to a first side of the central hull, and the second forward strut and the second aft strut are coupled to second side of the central hull.

26. The vessel of claim 25, wherein the first pod is slidably coupled to the first forward strut and the first aft strut, and the second pod is slidably coupled to the second forward strut and the second aft strut.

27. The vessel of claim 21, wherein the plurality of floatation devices includes a number of floatation devices corresponding to a number of struts included in the plurality of struts.

28. The vessel of claim 27, wherein one or more of the floatation devices are configured to be vertically translated to tilt the vessel.

* * * * *

UNITED STATES PATENT AND TRADEMARK OFFICE

CERTIFICATE OF CORRECTION

PATENT NO. : 6,877,450 B2
DATED : April 12, 2005
INVENTOR(S) : Terrence W. Schmidt et al.

It is certified that error appears in the above-identified patent and that said Letters Patent is hereby corrected as shown below:

Column 9,
Line 47, “walls.” should read -- wing walls. --.

Column 10,
Lines 22 and 37, “first side hulls” should read -- first side hull --.
Lines 24 and 39, “second side hulls” should read -- second side hull --.

Column 12,
Line 4, “claim 2,” should read -- claim 24, --.

Signed and Sealed this

Nineteenth Day of July, 2005

JON W. DUDAS
*Director of the United States Patent and Trademark Office*